US006206545B1

(12) United States Patent
Yan

(10) Patent No.: US 6,206,545 B1
(45) Date of Patent: Mar. 27, 2001

(54) ENHANCED SAFETY RETROFIT AND MANUFACTURING SYSTEM FOR LUMINARIA

(76) Inventor: Ellis Yan, 29 Annandale Dr., South Russell, OH (US) 44022

( * ) Notice: Subject to any disclaimer, the term of this patent is extended or adjusted under 35 U.S.C. 154(b) by 0 days.

(21) Appl. No.: 09/243,509

(22) Filed: Feb. 1, 1999

Related U.S. Application Data

(63) Continuation-in-part of application No. 08/980,564, filed on Dec. 1, 1997, now Pat. No. 5,938,316.

(51) Int. Cl.[7] ..... F21S 5/00

(52) U.S. Cl. ..... 362/249; 362/260; 362/265; 362/414; 362/216

(58) Field of Search ..... 362/260, 216, 362/414, 431, 265, 263, 296, 227, 249, 410

(56) References Cited

U.S. PATENT DOCUMENTS 4,604,552 * 8/1986 Alley et al. .
5,087,861 * 2/1992 Boyd et al. .
5,187,411 * 2/1993 Boyd et al. .
5,260,678 * 11/1993 Van Wagener .
5,286,216 * 2/1994 Volz .
5,424,610 * 6/1995 Pelton et al. ..... 362/417

* cited by examiner

*Primary Examiner*—Thomas M. Sember
(74) *Attorney, Agent, or Firm*—Joseph H. Taddeo

(57) ABSTRACT

An enhanced safety system for the conversion of luminaria that uses halogen lighting technology to a safe and efficient fluorescent lighting system. Quartz halogen bulbs operate at elevated temperatures and pressures. Fires have been known to have been started when a lighting fixture is accidentally toppled where some combustible material is in close proximity. This novel retrofit system provides for the safe and efficient operation of torchiere uplighted lighting systems. By retrofitting a lighting fixture to a fluorescent lamp using this adapter, there is an immediate benefit in reduced operating cost. For the equivalent light output, there can be a cost savings reduction by a factor of six or seven to one. In addition, the retrofit components can be used in the fabrication and assembly of newly designed and manufactured torchiere uplighted lighting systems.

22 Claims, 8 Drawing Sheets

ENHANCED SAFETY RETROFIT AND MANUFACTURING SYSTEM FOR LUMINARIA

REFERENCE TO PREVIOUSLY FILED APPLICATIONS

This application is a continuation-in-part of the prior patent application of Ellis Yan, identified by Ser. No. 08/980,564, filed Dec. 1, 1997, now U.S. Pat. No. 5,938,316 Titled AN ENHANCED SAFETY RETROFIT SYSTEM FOR LUMINARIA. Benefit of the filing date for original disclosure material in the parent domestic application is claimed under 35 USC 120 and 37 CFR §1.53.

FIELD OF INVENTION

The present invention relates in general to an enhanced safety system for the conversion of luminaria that uses halogen lighting technology to a safe and efficient fluorescent lighting system, and more particularly to a novel retrofit system for the safe and efficient operation of torchiere uplighted lighting systems.

In addition to using the present invention for the conversion of luminaria, it can also be incorporated in the fabrication and assembly of newly designed and manufactured torchiere luminaria.

BACKGROUND OF THE INVENTION

One of the most recent innovations used in lighting today is the halogen technology that features Double Ended Quartz (DEQ) bulbs. The advantage of using these bulbs is that they provide crisp, white light which produces richer and more vibrant colors in room accent pieces. Another advantage in using this new technology is that these bulbs generate more light than comparable wattage incandescent lamps, thereby resulting in some cost savings, when there is a need for using high intensity illumination.

Presently, these bulbs are designed for use in today's most contemporary lighting fixtures. They are commonly used in torchieres, uplighted fixtures, wall sconces, and chandeliers, as well as in outdoor lighting fixtures.

Because these bulbs operate at high temperatures and pressure and may shatter, there are several elements of safety that must be observed. It is generally recommended that the bulb be used in an enclosed fixture to protect persons and surroundings from hot flying fragments, in the event of a catastrophic failure of the bulb. Torchieres and uplighted fixtures, for example, are manufactured with the high intensity bulb being fully exposed with some having a small shroud to deflect the flying debris toward the bottom of the reflector.

Frequently, accidental fires in the home or office are started when the luminiare is placed to close to hanging decorative items, such as the foliage of small imitation ornamental trees or curtains flowing across the top of the torchiere reflector by a breeze.

Other precautions that must be made by the user when using luminaria having halogen bulbs are:

1) The luminaria should not be used if the bulb is scratched or broken because it may break during installation or while operating, thereby causing either a fire or personal injury.
2) The bulb operates at high temperatures. Touching the lamp while operating will burn one's skin. Gloves should be worn while replacing the bulb, only after a sufficient amount of time is allowed for cooling.

3) The luminaria should not be used by those who are sensitive to short wave ultra-violet radiation. Slight ultraviolet radiation from unprotected sources can cause skin and eye irritation following direct exposure. Passing the light through ordinary glass or plastic, such as wearing eye glasses, provides adequate protection.
4) When replacing the halogen bulb, only the rated voltage and wattage should be used in the fixture. It is essential that the lamp should not be operated in lighting power systems that exceed 100% of the rated voltage. Over-voltage operation results in short life, increases chance of skin and eye irritation, and increases pressure and tendency to break
5) The halogen bulb should not be used when in close proximity to combustible material or objects sensitive to drying or fading.
6) The halogen bulb should not be used when near liquids. The inadvertent splashing of a liquid on the bulb may cause it to shatter due to thermal shock caused by rapid cooling.
7) Deterioration of the lamp's socket contacts may adversely affect the bulb's performance. The socket should be replaced if deterioration is observed.
8) If the bulb is touched by one's bare hands, the bulb should be cleaned with denatured alcohol to prevent incipient failure.
9) It is important that the bulb be operated only in a horizontal position, plus or minus four degrees.
10) When replacing a halogen bulb with another, the following instructions should be observed:
    a) Turn the power off and allow the bulb to cool before attempting to replace it.
    b) Use gloves and eye protection when removing and installing bulbs.
    c) Do not touch the new bulb with bare hands. Clean the bulb with denatured alcohol if it has been touched.
    d) Firmly seat the bulb into the socket that is found at each end within the light fixture.

There is presently no method available to retrofit and dedicate an existing halogen lighting fixture to a safer operating fluorescent lamp, that is exceptionally more efficient in operation. Because of the many hazards and precautions that are necessary when using halogen bulbs, there is a particular need for a dedicated conversion system that will provide reliable, safe and efficient operation. In this regard, this invention fulfills this need.

Additionally, in recognition of the foregoing factors, OEM's have used variously shaped fluorescent lamps that fit within the uplighting receptacle for a torchiere. Double nested fluorescent lamps, 2D fluorescent lamps, and Delux F "finger" fluorescents are examples of such OEM halogen substitutes for torchieres.

Finally, OEM's may sequentially install incandescent lamps that are viewed as safer than halogens, followed by successive fluorescent lamps selected from the foregoing and appropriately dimensioned for a torchiere, for product promotions through reduced energy consumption.

SUMMARY OF THE INVENTION

The present invention is retrofit system for the conversion and dedication of a luminaire that uses an unsafe halogen quartz bulb, as used in torchiere lighting fixtures and other luminaria, to a safe operating circular fluorescent lamp. The size of the halogen bulbs that are used in present day lighting equipment is typically 300 watts.

Because these bulbs operate at much higher temperatures than equivalent sized fluorescent or incandescent bulbs, they present a high risk for starting a fire in a home or office. If drapes blow across and land upon the top of an open torchiere fixture or if there is any dangling foliage from a flammable imitation tree in close proximity to the top of the fixture, there is a setting for creating a dangerous fire. Also, if the fixture accidentally topples over while operating, a serious fire can result. One such fire occurred when a pet brushed against the fixture, toppling it over onto a bed, where the bed linens caught fire.

When comparing the relative merits of the various common sources of illumination, such as the fluorescent, halogen and incandescent lamps, with each having the same equivalent wattage, the performance of the fluorescent lamp excels in longevity, low cost efficient operation and in output illumination. Consider the following comparisons, where each lamp is rated at 40 watts.

The standard 40 watt incandescent bulb lasts about 300 hours and has an output of 450 lumens. A ruggedized 40 watt incandescent bulb lasts 1000 hours, but has a lower light output—360 lumens, because of a thicker gage filament.

A halogen 40 watt quartz bulb has an improved longevity of about 2000 hours, but has only a very slight improvement in light output—500 lumens.

The 40 watt fluorescent lamp, however, has tenfold improvement in longevity over the incandescent lamp and a fivefold improvement over the halogen lamp, about 10,000 hours. The same fluorescent lamp has over a six to seven times increase in light intensity—to approximately 3000 lumens. For equivalent light output, the fluorescent lamp uses 14 percent of the input power that is needed by the halogen lamp.

Fluorescent lamps are made in a variety of wattages and shapes. Both halogen lamps and incandescent bulbs are inefficient in operation, especially when compared to a fluorescent lamp that uses substantially less input energy to produce the same equivalent light output.

A preferred embodiment of the present invention includes the use of a circular fluorescent lamp that has an adapter mountable to the base of the circular lamp assembly. The adapter is designed to be installed into the existing holes that are used to mount the halogen bulb socket receptacles.

The benefits in using a fluorescent lamp in place of a halogen bulb in an open uplighted fixture are; safer operation, thereby reducing the risk of fire, substantially longer life, much greater lighting intensity and a reduction of operating costs.

It is therefore an object of the present invention to provide a retrofit system for luminaria to convert from halogen bulb technology to fluorescent lamp operation.

It is another object of the present invention to provide a retrofit system for luminaria that promotes safe operation to prevent damage to one's home or office by fire.

It is still another object of the present invention to provide a retrofit system for luminaria that operates more efficiently, thereby reducing the cost of operation and maintenance.

An additional object of the present invention is to provide a newly designed luminaria, using fluorescent lamp technology, for the safe operation with reduced risk of starting a fire, and one that will operate more efficiently, thereby reducing the cost of operation and maintenance.

These and other advantages of the present invention will become more apparent upon further reading of the detailed specification. It should be understood that deviations or modifications can be made without deviating or departing from the spirit of the present invention.

DETAILED DESCRIPTION OF THE PREFERRED EMBODIMENT

The present invention details a retrofit system for the conversion of a luminaire, such as a torchiere, from using an unsafe halogen bulb to using a safe reliable fluorescent lamp. Not only can the present invention be used in the conversion of luminaria, but it can also be used in the fabrication and assembly of newly manufactured torchiere luminaria. OEM's are confronted with the competing interests in design safety, manufacturing economics, product durability and economics in use, and aesthetics. Halogen lamps have been responsible for causing fires, especially when the fixture is accidentally knocked over and lies near some combustible material.

Incandescent bulbs are still widely used and accepted as the standard in the lighting industry, even though it has several drawbacks. These bulbs are not energy efficient creating much heat while in operation and are not long lasting, having a short life.

Halogen bulbs are slightly greater in efficiency than the incandescent bulb, but operate at much higher temperatures for the same light output.

Fluorescent lamps on the other hand are the most energy efficient lighting system, where they are widely used in factories, stores and office buildings. The most common fixture in use accepts tubes that are either four feet or eight feet in length.

Even though the initial cost of the fluorescent bulb may be greater, it usually quickly offsets this cost through its efficient operation. A fluorescent lamp uses about one seventh the amount of power used by either the incandescent or halogen bulb. Meanwhile, the fluorescent lighting industry is price competitive to an extreme. Profit margins for lamps are correspondingly small, and production volumes are very high, so that minute manufacturing cost advantages, a penny per lamp for example, are likely to be significant.

Due to varying demand of local markets, OEM's, distributors and retailers may customize torchieres by sequential installations of incandescent lamps that are viewed as safer than halogens, and further, by successive fluorescent lamps selected from ring-shaped and double nested fluorescent lamps, 2D fluorescent lamps, and Deluxe F "finger" fluorescents that can fit into the radial or depth dimension of the bowl-shaped uplighting receptacle of torchieres.

Through the use of the retrofit components, described herein, and their assembly, a newly manufactured torchiere lamp can be made having the same beneficial features of the retrofitted assembly. The benefits include greater safety with reduced risk of creating a fire, greater efficiency resulting in lower operating costs, and reduced maintenance cost because of the fluorescent lamp longevity.

The present invention will now be described in detail in accordance with the referenced drawings.

Figure 1:
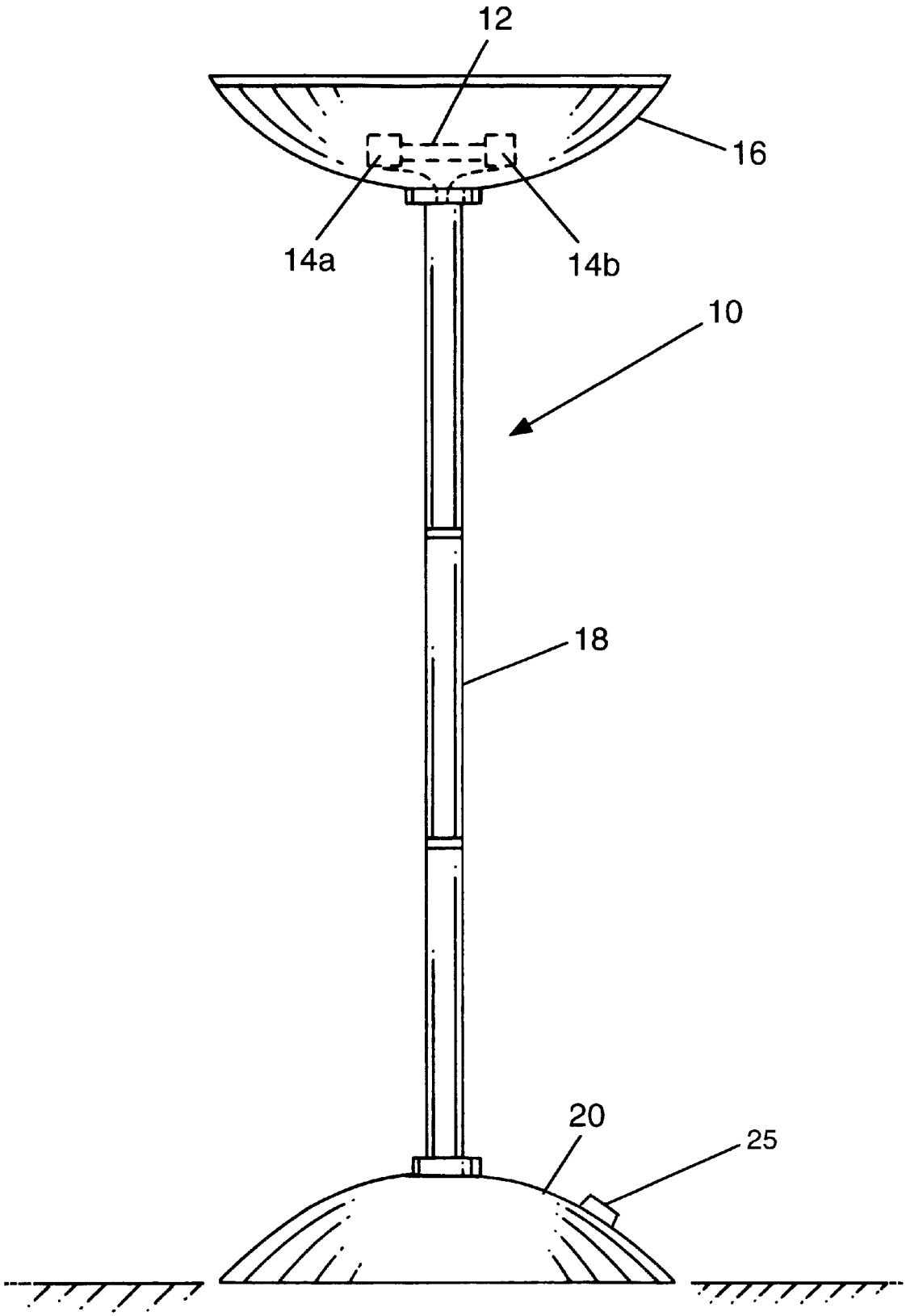
FIG. 1 is a side elevation of a typical complete luminaire, being a torchiere styled lamp, having a weighted base, a rising columnar support, a reflector and a halogen bulb.
Figure 2:
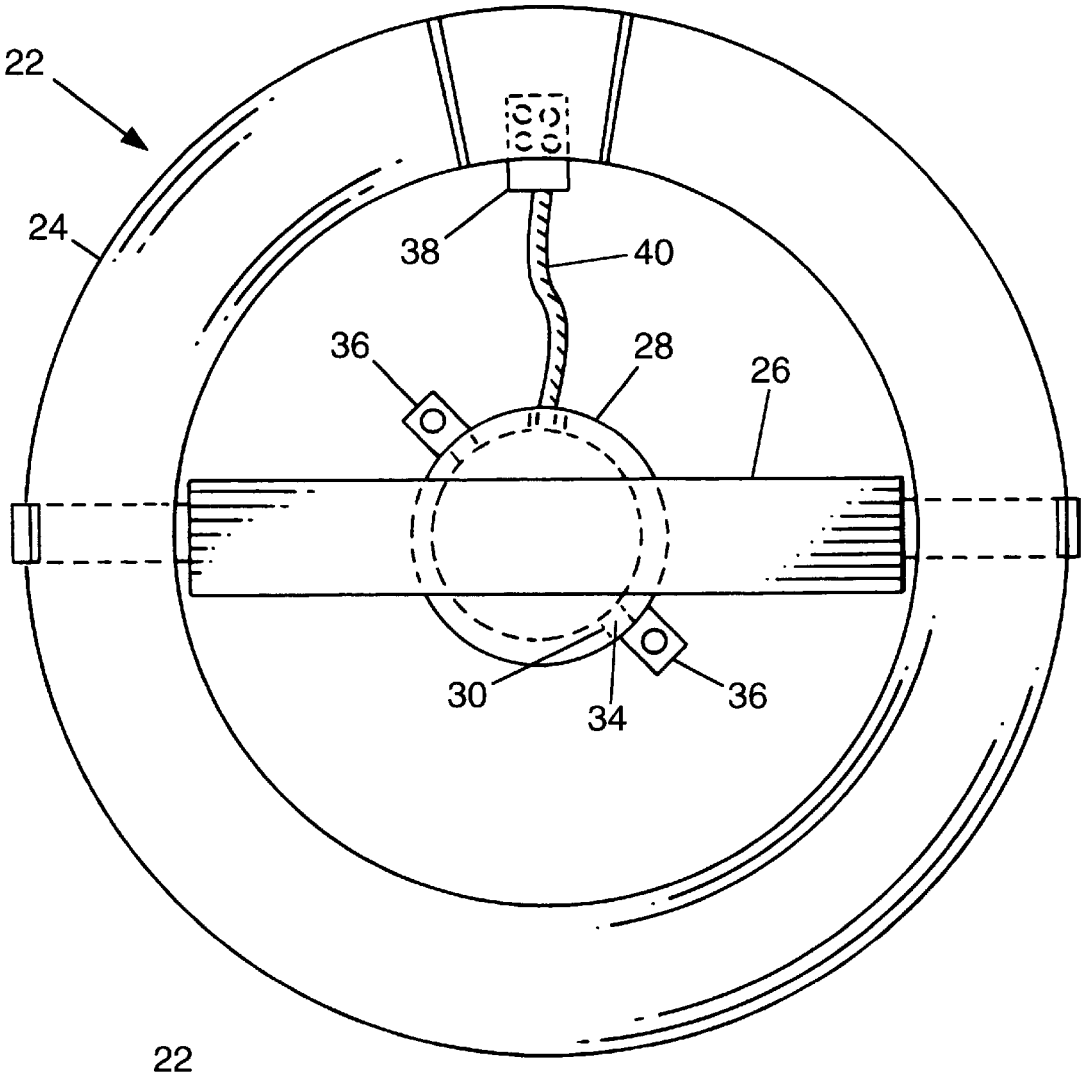
FIG. 2 is a top plan view of the fluorescent lamp assembly detailing the lamp support bracket and ballast housing.
Figure 3A:
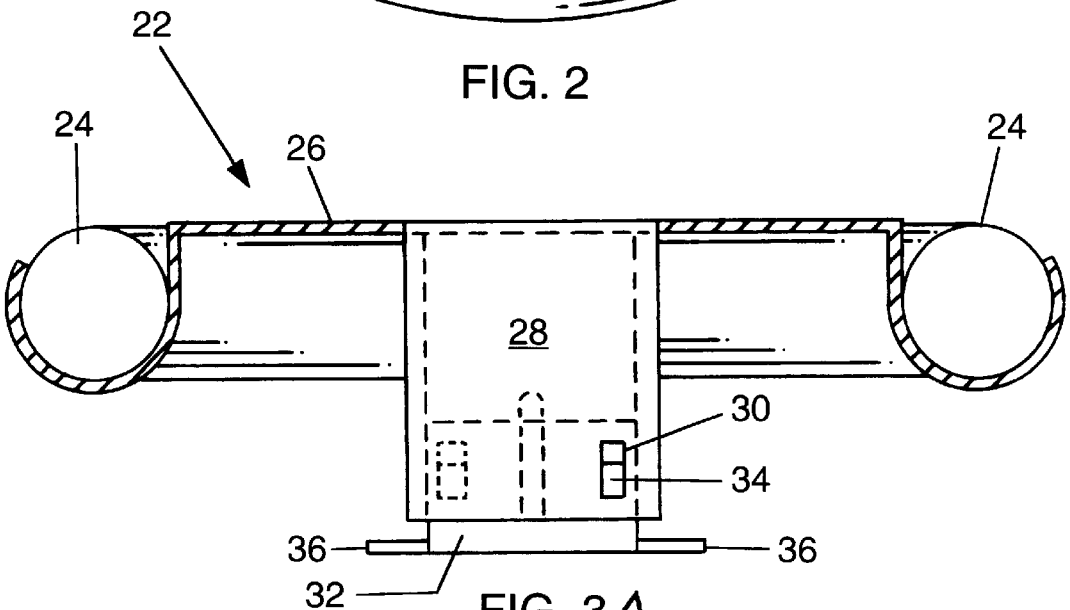
FIG. 3A is a side cross-sectional view of the fluorescent lamp assembly detailing the lamp support bracket and ballast housing.
Figure 3B:
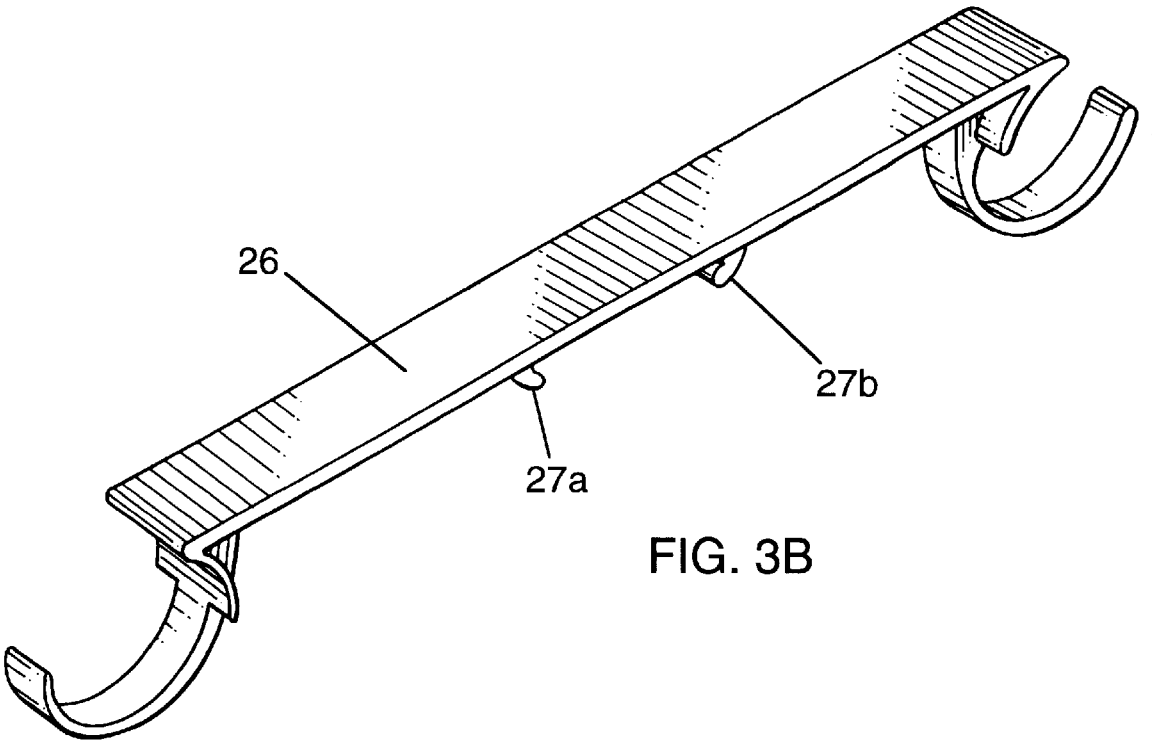
FIG. 3B is an exploded side view showing horizontal fluorescent lamp retaining, bar with snap tabs.
Figure 3C:
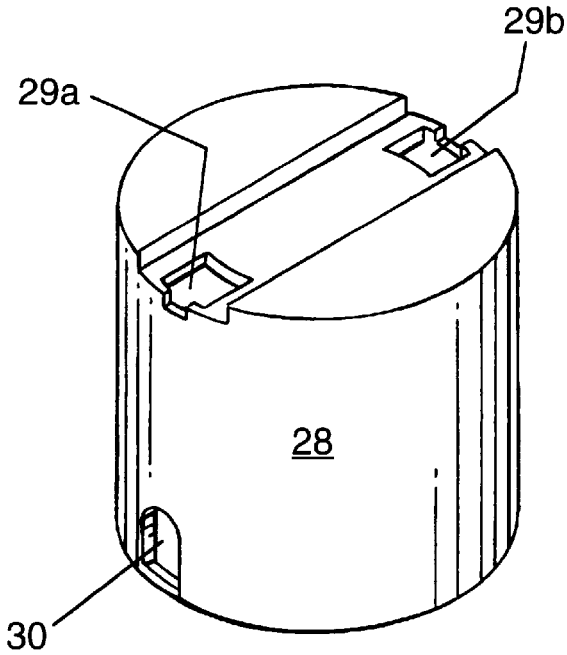
FIG. 3C is an exploded perspective for the ballast housing with top holes to receive the retaining bar tabs and side slots to receive the adapter base interlocking tabs.

Referring now to FIG. 1 of the drawings, illustrated is a typical luminaire floor lamp, being styled as the type of a torchiere 10. Located at the center of the uplight reflector 16 are the halogen lamp sockets, 14*a* and 14*b* that engage the halogen lamp 12. The reflector 16 is retained in the center by support columnar post 18. The bottom of columnar post the threads into the weighted base 20.

Shown in FIGS. 2, 3A,3B and 3C, is the adapter assembly 22 that holds circular fluorescent lamp 24. The fluorescent lamp that is used in the preferred embodiment is a 22 W circular lamp, such as a GE Kitchen and bath lamp—FC8T9-KB.

The adapter assembly 22 is comprised of a horizontal lamp retaining bar 26 that is removably secured to the ballast housing 28, using tabs 27*a*,27*b* that snap fit into corresponding holes 29*a*,29*b*, at the top of the housing. The ballast housing is sized so that it can hold a conventional inductive magnetic ballast or in the preferred embodiment, the lighter weight, reduced flicker, electronic ballast. The ballast housing has a pair of rectangular slots or holes 30 that form an interlocking aperture that can receive the interlocking tabs 34 of the adapter base 32, for a removable snap fit of the base tabs to the housing.

Figure 4:
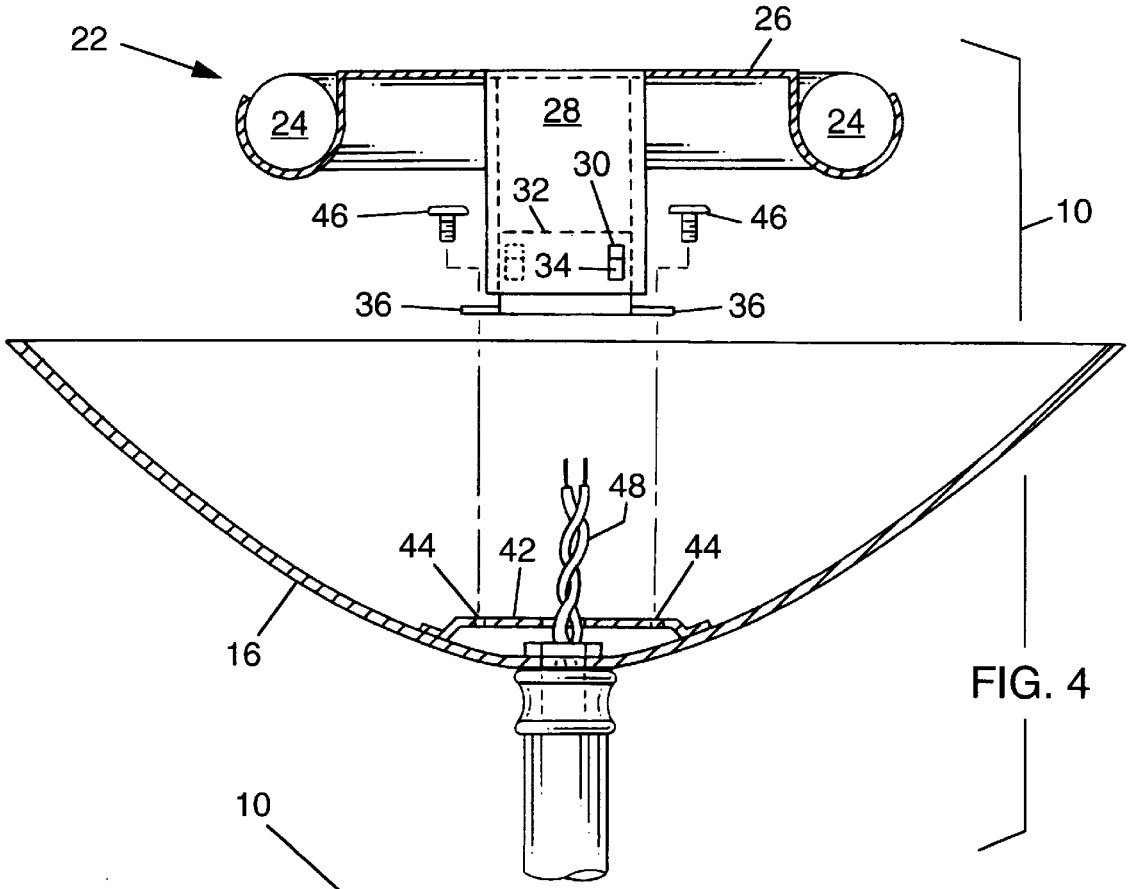
FIG. 4 shows an exploded cross-sectional view of the fluorescent lamp assembly retrofitting the halogen lamp and sockets.

Turning now to FIG. 4, illustrated is an exploded sectional view of the upper portion of the torchiere lighting fixture 10. The halogen bulb 12 and its associated sockets 14*a* and 14*b* are carefully removed from reflector bowl 16, as shown previously in FIG. 1, after disconnecting the lamp cord that is supplying power to the sockets and after removal of the two 6-32 hold-down machine screws 46. The fluorescent lamp 24 is carefully removed from the adapter assembly 22, after disconnecting interconnecting cable 40 by removal of the four-pronged plug 38. The adapter base 32 is disassembled from the ballast housing 28 by depressing interlocking tabs 34 toward each other. The power-cord 48 is subsequently wired to the electronic ballast using wire-nuts. The adapter assembly is then lowered into reflector 16, while aligning the holes in the tabs 36 with the threaded holes 44, found in the bracket 42. Bracket 42 is normally spot welded in the lower central portion of reflector 16. Two 6-32 pan head machine screws 46, secure the adapter assembly to bracket 42.

The assembly is finalized by snapping the ballast housing compartment 28 onto the adapter base 32, while engaging the interlocking tabs 34 into the rectangular slots or apertures 30. The fluorescent lamp 24 is then snapped into the lamp retaining bar 26. Completing the assembly is the insertion of the 4-pin plug 38 to the pins on fluorescent lamp 24.

Figure 5:
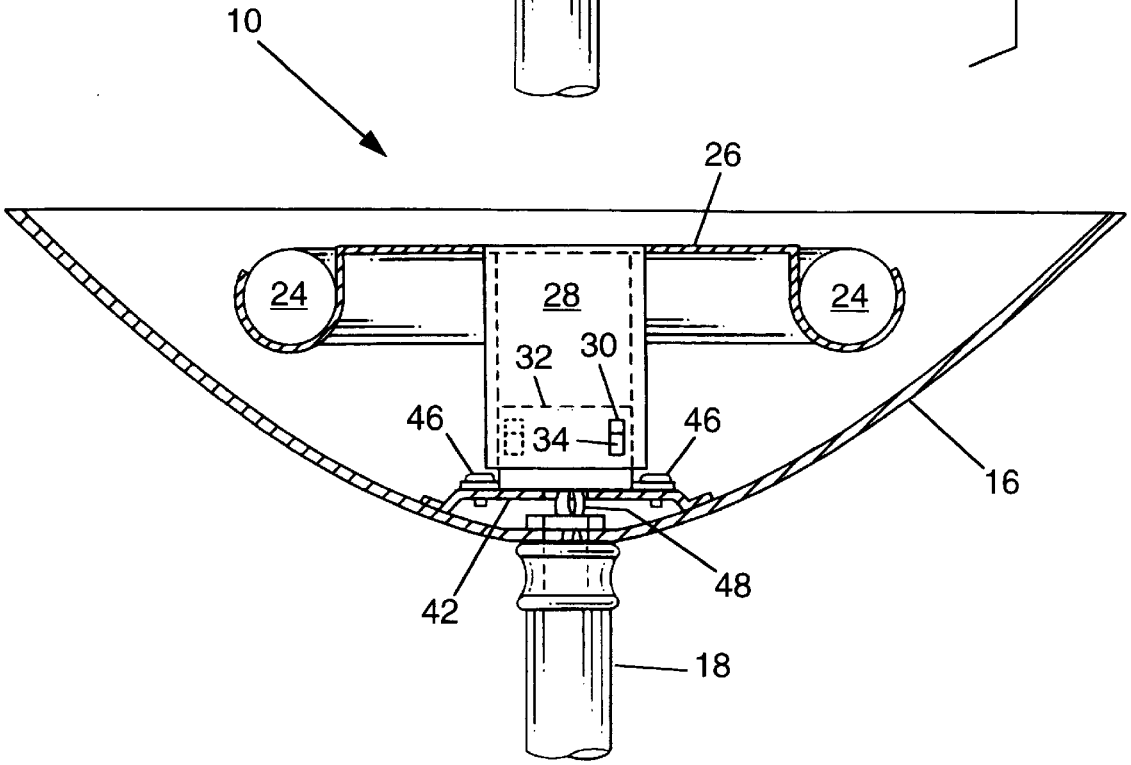
FIG. 5 illustrates the completed sectional view of a torchiere lighting fixture after removing the halogen sockets and bulb assembly and retrofitting with the fluorescent lamp assembly.

FIG. 5 details the integration of the completed assembly of the present invention into a typical torchiere lighting fixture. By using the adapter of the present invention, together with a companion circular fluorescent bulb 24, an enhanced safety lighting retrofit system provides a safe and efficient luminaire.

Figure 6:
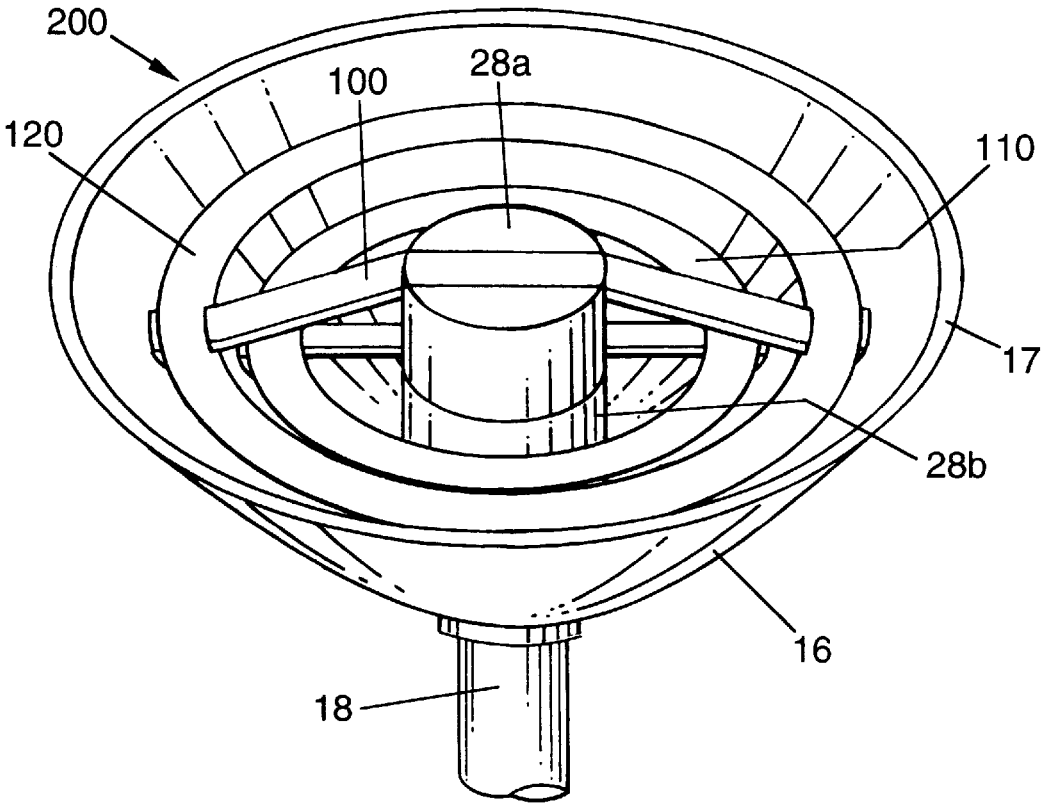
FIG. 6 is a perspective view of a torchiere using two nested fluorescent lamps in a 3-way lamp.
Figure 7A:
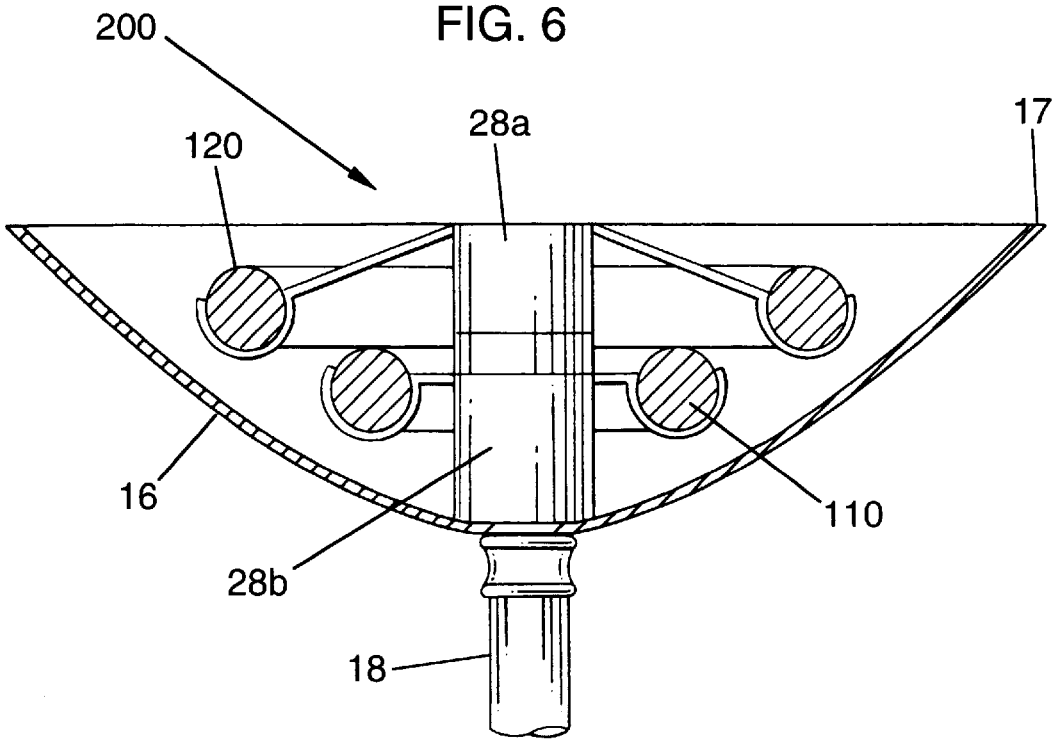
FIG. 7A is a side elevation of the 3-way lamp torchiere.
Figure 7B:
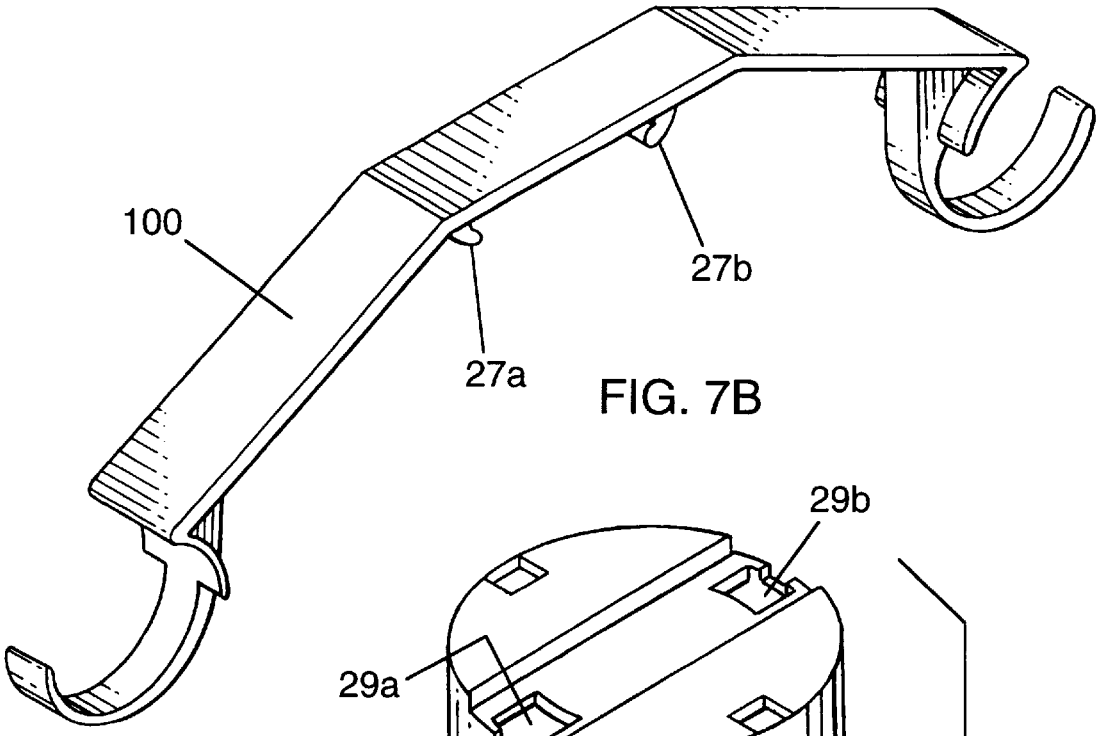
FIG. 7B is a side elevation of a fluorescent lamp retainer with a batwing design.
Figure 7C:
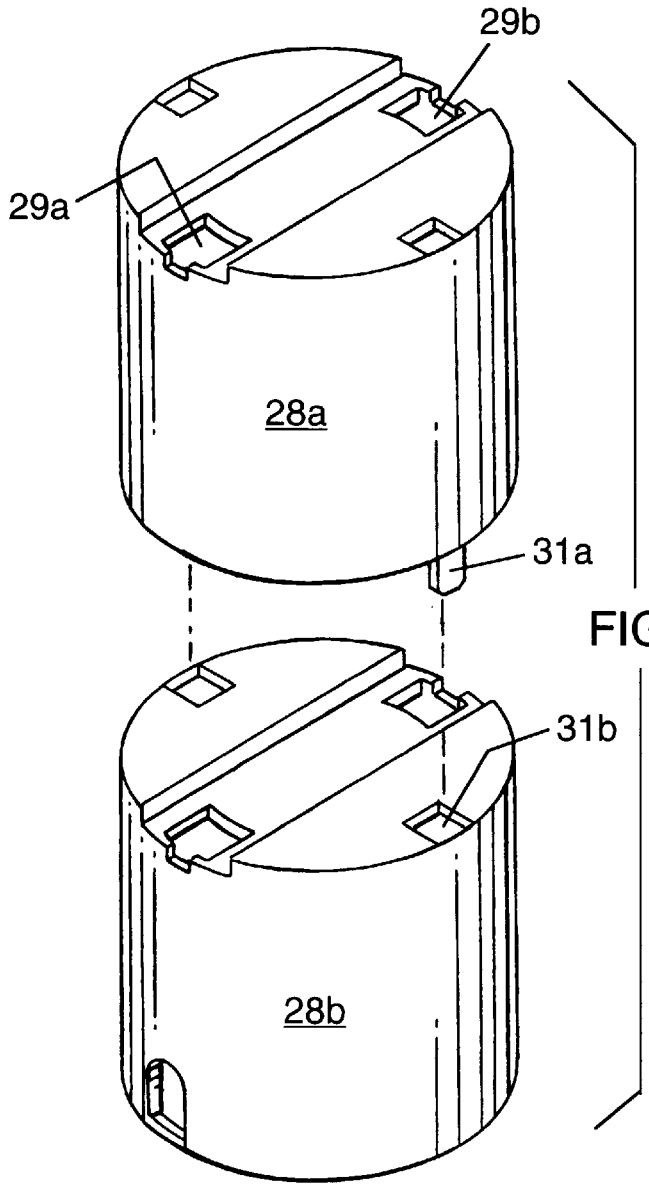
FIG. 7C shows means for connecting successive ballast housings to construct the ballast assembly using plugs in corresponding apertures.

FIGS. 6, 7A, and 7B demonstrate that use of fluorescent lighting can fulfill the light intensity requirements of a halogen lamp. There is shown, in FIGS. 6 and 7A, a 3-way fluorescent torchiere lamp 200. This 3-way lamp is comprised of an inner circular 20 watt fluorescent lamp 110 and an outer circular 30 watt fluorescent lamp 120. A 3-way switch 25 provides three levels of illumination; the first being the operation of a 20 watt lamp, such as an FCST9; the second being the operation of the 30 watt lamp, such as an FCL-30; and the third level being both lamps illuminated for a total of 50 watts. The third level of illumination provides the same light intensity comparable to that provided by a halogen bulb. Each lamp uses an individual ballast and housing, shown as 28*a* and 28*b*, that are formed in a ballast assembly with each successive ballast housing or compartment installed above, and supported by, the prior housing, while the initial, (or lowest), ballast housing is mounted on the reflector bracket as previously disclosed. The fluorescent retainer or retaining bar 100 has a "downwing" or "batwing" shape in FIG. 7B, so that the substitute fluorescent lamps remain within the confines, (i.e., below the radial height of the circumferential rim 17), of the torchiere reflector 16. The ballasts are preferably connected with plugs 31*a* inserted in corresponding apertures 31*b* as shown in FIG. 7C.

Figure 8:
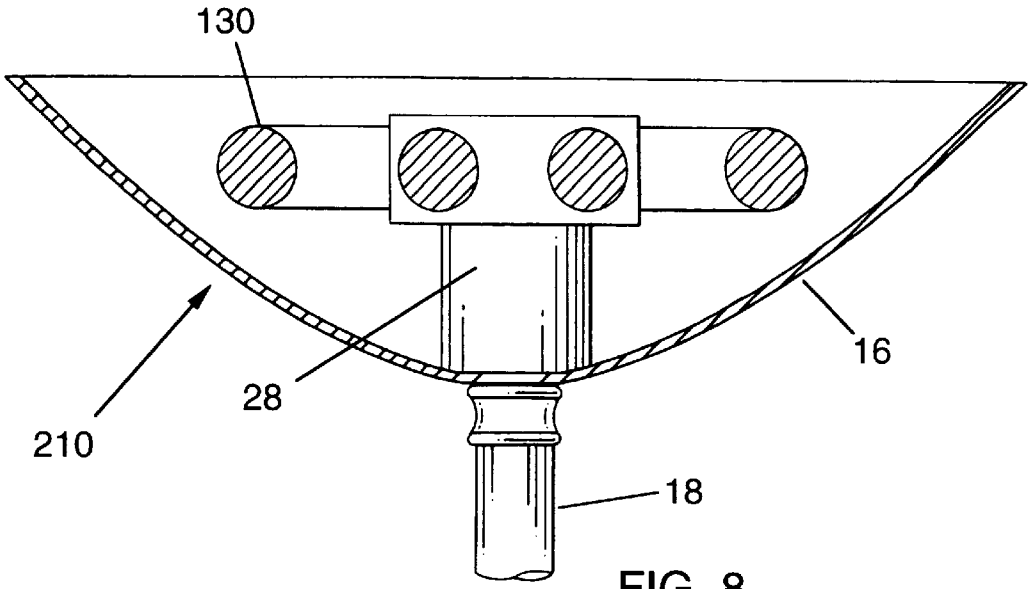
FIG. 8 is a side elevation that illustrates the application of a 2D fluorescent lamp in a torchiere.
Figure 9:
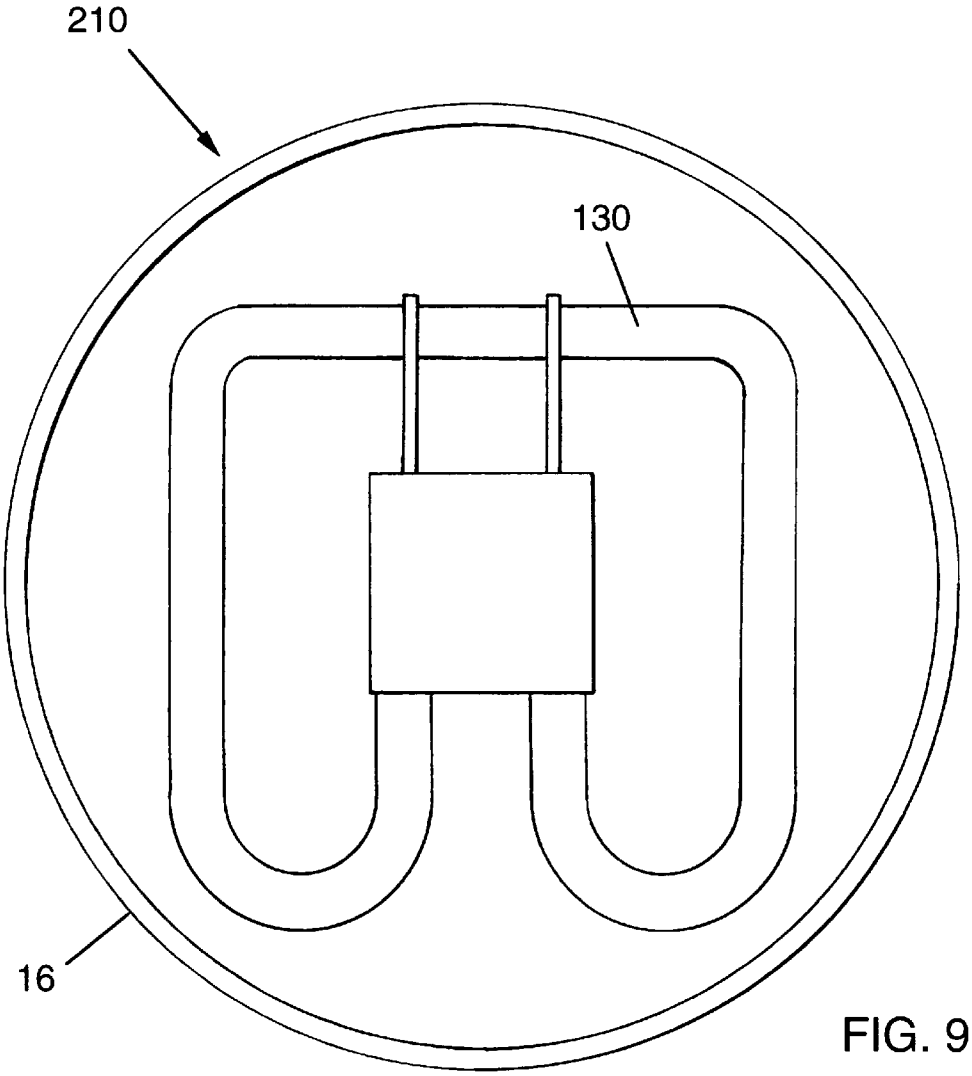
FIG. 9 is a top view of the torchiere of FIG. 8 showing the 2D fluorescent lamp.

FIGS. 8 and 9 illustrate, as a third alternative embodiment, the use of a 2D fluorescent lamp, such as an F552D/835, in a torchiere lamp 210.

Figure 10:
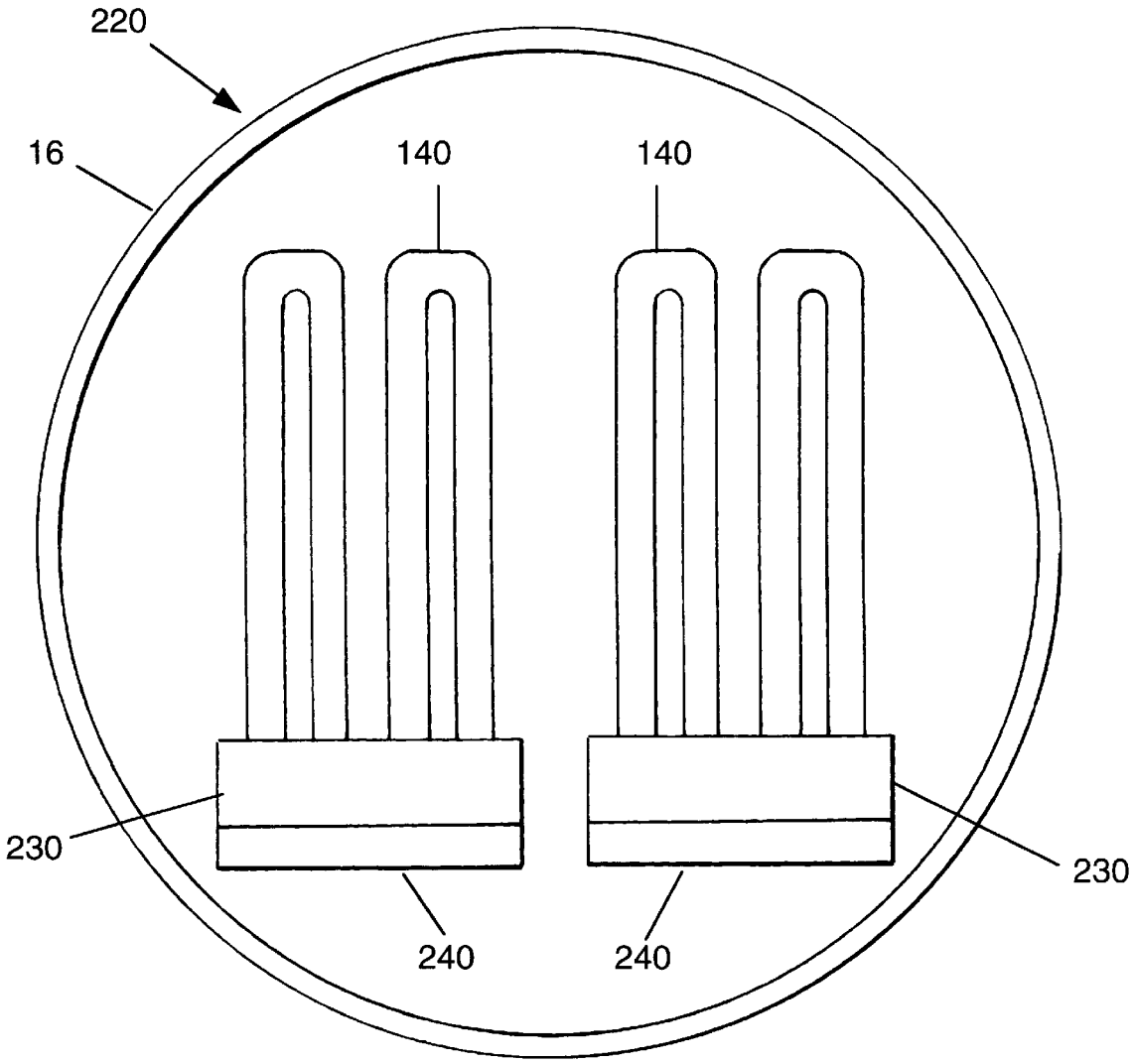
FIG. 10 depicts a top plan view of a torchiere using two Dulux F fluorescent lamps, such as a CF36DF/830 for providing an even distribution of light.

In still another alternative embodiment, as shown in FIG. 10, is the torchiere reflector 220, using two Dulux F fluorescent lamps, such as a CF36DF/830. A plurality of these lamps provide a uniform gradient over the entire reflector. The base of the Dulux F fluorescent lamp 230 plugs into a mating socket 240.

In the alternative embodiments that are shown, it should be obvious to those skilled in the art that the reflectors may be constructed in various arbitrary shapes and sizes; that a plurality of fluorescent lamps, each with their respective ballast may be used; and that as newly designed arbitrary shaped fluorescent lamps emerge into the marketplace; that they do not detract from the true spirit of the present invention.

While specific embodiments of the present invention have been shown and described in detail to illustrate the principles of the invention, it should be understood the that other modifications or embellishments can be made without departing from the true spirit of the invention.

I claim:

1. A light adapter apparatus to replace a halogen lamp in an uplighting reflector bracket of a torchiere fixture with fluorescent lighting, comprising:

a ballast assembly including a plurality of ballasts, each having a housing wherein each successive housing of the plurality is positioned above and supported by a prior housing of the plurality with a fluorescent lamp respective to each ballast clamped near the housing by a removable lamp retainer including a downward batwing retainer for suspending the fluorescent lamps below a radial height of a circumferential rim of the torchiere, an initial, lowest ballast housing of the assembly removably interconnected to the bracket by an adapter base secured on the bracket, and each ballast wired to a torchiere power-cord through a switch providing levels of illumination for substitution of fluorescent lighting having a light intensity of the halogen lamp replaced in the torchiere fixture that is safer, more durable and economical in manufacture and use.

2. The apparatus described in claim 1, further comprising:

means for removably securing the adapter base on the bracket.

3. The apparatus described in claim 2, further comprising:

means for removably interconnecting the ballast assembly to the bracket.

4. The apparatus of claim 3, further comprising:

means for removably securing the lamp retainer to each housing.

5. The apparatus of claim 4, further comprising:

means for removably clamping a fluorescent lamp near each housing.

6. The apparatus of claim 5, wherein the fluorescent lighting comprises a plurality of circular fluorescent lamps.

7. The apparatus of claim 5, wherein the fluorescent lighting comprises a pair of fluorescent lamps nested in the reflector.

8. The apparatus of claim 7, the switch comprising a three-way switch for providing three levels of illumination.

9. The assembly of claim 5, wherein the fluorescent lighting comprises a 2D fluorescent lamp.

10. The assembly of claim 5, wherein the fluorescent lighting comprises a pair of Delux F fluorescent lamps.

11. The assembly according to claim 5, wherein each successive ballast housing after the initial, lowest housing is snap-locked secured to the prior housing of the plurality to expedite installation and removal of each ballast.

12. The light adapter apparatus described in claim 1, wherein each successive ballast housing after the initial, lowest housing is removably secured to the prior housing of the plurality to expedite installation and removal of each ballast.

13. A retrofit safety system for installation in a torchiere floor lamp of the type that includes an uplight reflector attached to a support column, the reflector having a pair of halogen lamp sockets that are fixed on a reflector mounting bracket for engaging a halogen lamp powered from a lamp power cord, the retrofit system effective for conversion and dedication of a torchiere lamp that uses a halogen quartz bulb, to a safe operating fluorescent lamp, comprising:

an adapter base, having outward projecting tabs, removably connected to the bracket;

an adapter assembly including a pair of ballast housings each housing holding a ballast and having upper and lower portions, wherein the initial, lower housing of the pair includes a pair of holes near the lower portion that form an interlocking aperture to receive corresponding tabs of the adapter base, and having an associated inner circular fluorescent lamp; the second, upper ballast housing of the pair communicating with an outer circular fluorescent lamp; and, wherein a 3-way switch provides three levels of illumination, the first being illumination of the inner fluorescent, the second being illumination of the outer fluorescent and the third level being both lamps simultaneously illuminated;

wherein each ballast housing includes a retaining bar removably secured on and radiating from the housing;

wherein the retaining bar projection includes first and second terminal ends each end having an upward oriented U-shaped configuration;

wherein the U-shaped terminal ends comprises a flexible bulb snap retainer for retention of a circular fluorescent lamp mounted in the snap retainer by finger pressure.

14. The retrofit safety system according to claim 13, wherein the reflector is shaped like a bowl having a height, a circumferential rim, and a center; and the bowl is fixed to the column near the center;

wherein the adapter assembly has a height dimension that is lower than the height of the bowl rim, whereby the florescent lamp is suspended within of the bowl shaped reflector.

15. The retrofit safety system in claim 14, wherein each fluorescent lamp comprises a circular shaped cylinder with a circumference and the lamp interfits into the U-shaped snap retainer at any point on the circumference.

16. The retrofit safety system according to claim 15, each fluorescent lamp further comprising a socket to receive the interconnection cable plug; and, wherein each fluorescent lamp communicates with the lamp power cord through the ballast, ballast cable and plug.

17. The retrofit safety system of claim 16, wherein the column is threaded into the base; and, wherein the bracket is welded on the inner surface, near a lower portion of the bowl reflector.

18. The retrofit safety system of claim 17, wherein the bracket includes a pair of fastener holes therethrough, the adapter base mounting tabs also having corresponding holes therethrough; and, the adapter assembly is secured to the reflector with fasteners using said bracket holes previously employed in securing the halogen bulb sockets to the reflector.

19. A method for installing a fluorescent light adapter apparatus in substitution for a halogen lamp in an uplighting reflector bracket of a torchiere fixture, for converting the torchiere to a safe operating fluorescent lighting system, comprising the steps of:

removing the halogen lamp;

providing a fluorescent light adapter apparatus having a ballast assembly including a 3-way switch forward of a pair of ballasts, each having a housing and a respective fluorescent lamp clamped near the housing by a removable lamp retainer, and an adapter base with base tabs and interlocking tabs;

mounting the apparatus on the bracket and, adding ballasts in the ballast assembly and fluorescent lamps for additional safe lighting as required.

20. The method of claim 19, further comprising the step of:

wiring ballast assembly to a torchiere power-cord for a lamp power supply and installation of fluorescent lighting in the torchiere fixture that is safer, more durable and economical in manufacture and use.

21. A method according to claim 20, wherein the removing the halogen lamp step includes the steps of:

disconnecting a lamp cord that is supplying power to the halogen lamp and its associated sockets;

removing the halogen bulb and its associated sockets from the reflector; and, disconnecting the interconnecting cable by removal of a four-pronged plug.

22. A method according to claim 21, wherein the mounting the apparatus step includes the steps of:

removing the fluorescent lamps from the adapter assembly;

disassembling the adapter base from the ballast housing by depressing adapter base interlocking tabs toward each other;

lowering the adapter assembly into the reflector;

aligning holes in the adapter base tabs with corresponding threaded holes in the bracket;

securing the adapter base to the bracket;

snapping the ballast housing onto the adapter base while engaging the interlocking tabs into rectangular aperture of the ballast housing;

clamping each fluorescent lamp by snap-locking the lamp into a respective lamp retaining bar;

inserting a 4-pin plug to the pins on each fluorescent lamp for electrical power.

* * * * *